US011207732B2

(12) United States Patent
He et al.

(10) Patent No.: US 11,207,732 B2
(45) Date of Patent: Dec. 28, 2021

(54) INTEGRATED METHOD FOR MANUFACTURING HIGH-TEMPERATURE RESISTANT THIN-WALLED COMPONENT BY PREFORMING BY LAYING METAL FOIL STRIP

(71) Applicant: DALIAN UNIVERSITY OF TECHNOLOGY, Liaoning (CN)

(72) Inventors: Zhubin He, Liaoning (CN); Jiangkai Liang, Liaoning (CN); Yi Xu, Liaoning (CN); Wei Du, Liaoning (CN); Yanli Lin, Liaoning (CN); Kailun Zheng, Liaoning (CN); Peng Lin, Liaoning (CN); Gang Liu, Liaoning (CN); Shijian Yuan, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 0 days.

(21) Appl. No.: 16/938,648

(22) Filed: Jul. 24, 2020

(65) Prior Publication Data

US 2021/0213528 A1 Jul. 15, 2021

(30) Foreign Application Priority Data

Jan. 13, 2020 (CN) ..... 202010031405.7

(51) Int. Cl.
*B22F 7/04* (2006.01)
*B22F 3/10* (2006.01)

(52) U.S. Cl.
CPC ..... *B22F 7/04* (2013.01); *B22F 3/1039* (2013.01)

(58) Field of Classification Search
CPC .... B21C 37/02; B22F 7/04; B22F 7/02; B22F 3/1039; B21D 31/04; B21D 33/00
See application file for complete search history.

(56) References Cited

FOREIGN PATENT DOCUMENTS

CN 107081345 A * 8/2017
JP 2006052130 A * 2/2006 ..... C04B 37/026

OTHER PUBLICATIONS

Isaev et al. ("Machining of thin-walled parts produced by additive manufacturing technologies." Procedia CIRP 41 (2016): 1023-1026. ). (Year: 2016).*
CN-107081345-A english translation (Year: 2017).*
JP-2006052130-A english translation (Year: 2006).*

* cited by examiner

*Primary Examiner* — Anthony J Zimmer
*Assistant Examiner* — Ricardo D Morales
(74) *Attorney, Agent, or Firm* — MH2 Technology Law Group, LLP

(57) ABSTRACT

An integrated method for manufacturing a high-temperature resistant thin-walled component by preforming by laying a metal foil strip. The integrated manufacturing method includes: designing a preform, preparing a support die, determining a thickness of a foil strip, determining a width of the foil strip, developing a laying process, laying an A foil strip and a B foil strip, obtaining an AB laminated preform, bulging the preform, performing a reactive synthesis and a densification process of a bulged component, and performing a subsequent treatment of the thin-walled component. Various embodiments obtain an integral thin-walled preform with a complex structure, a uniform wall thickness and a shape close to the final part by continuously laying a metal foil strip with an appropriate width.

3 Claims, 5 Drawing Sheets

INTEGRATED METHOD FOR MANUFACTURING HIGH-TEMPERATURE RESISTANT THIN-WALLED COMPONENT BY PREFORMING BY LAYING METAL FOIL STRIP

CROSS REFERENCE TO RELATED APPLICATIONS

This application claims priority under 35 U.S.C. § 119 to Chinese Patent Application No. 202010031405.7, which was filed on 13 Jan. 2020, the contents of which is hereby expressly incorporated by reference in its entirety.

TECHNICAL FIELD

The present invention relates to the manufacturing field of thin-walled components, and in particular, to an integrated method for manufacturing a high-temperature resistant thin-walled component by preforming by laying a metal foil strip.

BACKGROUND

With the rapid development of aviation and aerospace technology, the new generation aircraft has continuously increased the flight distance and speed. Meanwhile, the service temperature of the high-temperature complex thin-walled components such as intake ducts and exhaust nozzles in the aircraft has also continuously increased. However, existing titanium alloys and high-temperature alloys cannot meet such high service temperature requirements because of their low heat resistance (about 500° C.). Therefore, it is necessary to use materials with higher heat resistance such as intermetallic compounds (IMCs) TiAl and NiAl. The operating temperature of TiAl is 600-850° C. The operating temperature of NiAl is as high as 900-1000° C., and its tensile strength is still higher than 100 MPa at 1100° C. IMCs are ideal high-temperature structural materials. In addition to high heat resistance, IMCs also have low density, high hardness, excellent oxidation resistance, good corrosion resistance and high structural stability. Therefore, IMCs are superior to high-temperature titanium alloys and high-temperature nickel-based alloys in the field of high-temperature engineering. In recent years, the manufacture and application of thin-walled components made of TiAl, NiAl and other IMCs have become a research hotspot in the advanced manufacturing field.

At present, the complex thin-walled components of titanium alloys and high-temperature alloys are directly shaped out of a thin-walled sheet/tube (obtained by rolling, etc.) through the forming techniques such as superplastic forming (SPF) and hot stamping forming (HF). The preparation of the raw sheet/tube of the titanium alloy and high-temperature alloy and the subsequent formation of the complex thin-walled component are two relatively independent processes. However, TiAl and NiAl are inherently brittle and thus are difficult to prepare thin-walled sheets/tubes by conventional methods. Even if a sheet/tube can be prepared, it is extremely difficult to adapt them into a complex component at room temperature and warm conditions. Therefore, the use of such materials has been greatly restricted. In order to solve the above problem, an invention patent (Patent No. 201710448620.5) proposes a method for preparing a curved sheet component from a NiAl alloy by integrating a synthesis and forming. In this method, a large-sized Ni foil and a large-sized Al foil are alternately laminated and hot-pressed into a sheet. Then the sheet undergoes a hot gas bulging process to obtain a shape of the component. Finally, a high-temperature vacuum heat treatment and other steps are performed to obtain a final NiAl alloy curved part. This method first prepares a simple sheet from a Ni/Al foil laminate. The simple sheet will undergo a large and complex deformation when the hot gas bulging is performed to obtain the shape of the component, which is prone to problems such as local thinning, cracking and wrinkling. An invention patent (Application No: 201910444894.6) proposes a method for preparing a thin-walled tube from a Ni/Al alloy by integrating forming and control. In this method, a large-sized Ni foil and a large-sized Al foil are alternately laminated, rolled and welded into a laminated foil tube. The laminated foil tube is subjected to a gas bulging forming process and a synthetic reaction in a gas bulging die to obtain a thin-walled NiAl alloy tube. Because the laminated foil tube prepared by this method is a simple cylinder or cone which is shaped greatly different from the final component, the laminated foil tube will also undergo a large and complicated deformation during the gas bulging forming process. As a result, problems such as local thinning, cracking and wrinkling are prone to occur, and the structural properties of the welding material and the base metal at the weld are difficult to control. Therefore, it is still difficult to manufacture a thin-walled component with a complicated shape and a uniform wall thickness by the above methods. At present, the manufacture of complex thin-walled components with heat-resistant IMCs such as TiAl and NiAl has become a bottleneck in China's aviation and aerospace fields.

In summary, in the conventional forming methods, the simple sheets of the IMCs (such as TiAl and NiAl) are difficult to prepare and deform at room temperature and warm conditions, and serious wall thickness irregularities occur due to the bulging deformation of the simple preformed laminates. Therefore, there is an urgent need to develop a new method to manufacture a complex thin-walled component out of a high-temperature resistant material.

SUMMARY

An objective of the present invention, among others, is to provide an integrated method for manufacturing a high-temperature resistant thin-walled component by preforming by laying a metal foil strip. At least one embodiment of the present invention solves the problem that the conventional forming methods are difficult to manufacture a high-temperature resistant complex thin-walled component. In these methods, a sheet is difficult to prepare with a heat-resisting intermetallic compound (IMC, such as TiAl and NiAl), the sheet is difficult to deform, and a wall thickness irregularity occurs due to a bulging deformation.

To achieve the above purpose, at least one embodiment of the present invention provides the following technical solutions:

An integrated method for manufacturing a high-temperature resistant thin-walled component by preforming by laying a metal foil strip includes the following steps:

step 1, designing a preform: analyzing a characteristic of a complex thin-walled component, and determining a shape of a desired thin-walled preform by a theoretical calculation or simulation;

step 2, preparing a support die: preparing a support die by using an inner wall of the preform as a characteristic surface;

step 3, determining a thickness of a foil strip: calculating a total thickness ratio of an A foil strip composed of a metal A to a B foil strip composed of a metal B, and determining a thickness of a single-layer foil strip, according to a ratio of the number of atoms A to the number of atoms B in an IMC composed of the metal A and the metal B;

step 4, determining a width of the foil strip: analyzing a characteristic zone of the preform to determine a width of a single-layer A foil strip and a single-layer B foil strip applicable in each characteristic zone, and pretreating a desired single-layer A foil strip and a desired single-layer B foil strip;

step 5, developing a laying process: determining a sequence and a path for laying each layer of foil, according to the thickness of the single-layer A foil strip and the single-layer B foil strip and the width of the A foil strip and the B foil strip in each zone determined in step 3 and step 4;

step 6, laying the A foil strip and the B foil strip: alternately laying a plurality of A foil strip layers composed of the A foil strip and B foil strip layers composed of the B foil strip on a surface of the support die according to the laying process developed in step 5; filling a gap between vertically adjacent A foil strips on each A foil strip layer with an A liquid or A powder made of the metal A; filling a gap between vertically adjacent B foil strips on each B foil strip layer with a B liquid or B powder made of the metal B;

step 7, obtaining an AB laminated preform: separating an AB laminated preform prepared in step 6 from the support die to obtain the AB laminated preform;

step 8, bulging the preform: placing the AB laminated preform into a bulging die to bulge to fully fit with the die to obtain a component with a desired shape;

step 9, performing a reactive synthesis and a densification process of the bulged component: subjecting the AB laminated component to a diffusion synthesis and a densification process under high temperature and high pressure in the bulging die to obtain a complex thin-walled alloy component;

step 10, performing a subsequent treatment of the thin-walled component: cutting or polishing an end and a surface of the formed thin-walled alloy component.

Preferably, in step 2, the support die is prepared from a foam plastic by using an inner wall of the thin-walled shaped component as a characteristic surface by three-dimensional (3D) printing.

Preferably, in step 6, two foil strip nozzles are used to lay the A foil strip and the B foil strip alternately layer by layer; a powder nozzle is used to spray an A liquid or A powder to fill a gap between adjacent A foil strips on the A foil strip layer; a powder nozzle is used to spray a B liquid or B powder to fill a gap between adjacent B foil strips on the B foil strip layer; the support die is rotated by a rotary platform; the foil strip nozzle and the powder nozzle are driven by a multi-degree-of-freedom robotic arm to realize space movement and swing.

Preferably, in step 8, the AB laminated preform is placed into the bulging die heated in advance to 500-800° C. to bulge to fit the forming die.

Compared with the prior art, various embodiments of the present invention achieve the following beneficial effects:

1. The method provided by an embodiment of the present invention obtains an integral thin-walled preform with a complex structure, a uniform wall thickness and a shape close to the final part by continuously laying a metal foil strip with an appropriate width. This embodiment of the present invention does not need to weld the thin-walled preform, and thus solves the problem of weak comprehensive performance of a weld zone in the conventional method of preparing, rolling and welding a laminated sheet into a cylinder. In addition, embodiments of the present invention reduce a subsequent bulging deformation, avoiding local bulging, thinning and cracking, undercuts at the parting during die closing, and wrinkles due to uneven distribution of materials in each zone.

2. At least one embodiment of the method provided by the present invention uses a metal foil as a raw material, which is convenient to acquire and has controllable specifications and components. Embodiments of the present invention can adjust the wall thickness of the thin-walled component by adjusting the number of a raw A foil layer and a raw B foil layer. The preparation process is safe, non-polluting and low in cost.

3. The method provided by at least one embodiment of the present invention makes good use of the plastic formability of the metal foil when bulging in the die, and thus can easily prepare a part with a complex shape and high dimensional accuracy. In addition, various embodiments of the present invention also significantly lower the requirements for the use of the die material.

4. At least one embodiment of the method provided by the present invention realizes excellent composition uniformity of the complex thin-walled alloy component by controlling the parameters of a reactive synthesis in a bulging die and realizes excellent structural density thereof by controlling the parameters of a densification process.

5. At least one embodiment of the method provided by the present invention successively performs the bulging forming of the preform and the reactive synthesis and densification process of a bulged component in the same die. This embodiment of the present invention satisfies the synchronous regulation of the structure and performance of each zone and effectively prevents the problem of reduced dimensional accuracy caused by the transfer of a thin-walled component. Meanwhile, embodiments of the present invention reduce the procedures and improves production efficiency.

BRIEF DESCRIPTION OF DRAWINGS

To describe the technical solutions in the examples of the present invention or in the prior art more clearly, the following briefly introduces the accompanying drawings required for describing the examples. Apparently, the accompanying drawings in the following description show merely some examples of the present invention, and a person of ordinary skill in the art may still derive other drawings from these accompanying drawings without creative efforts.

Figure 1:
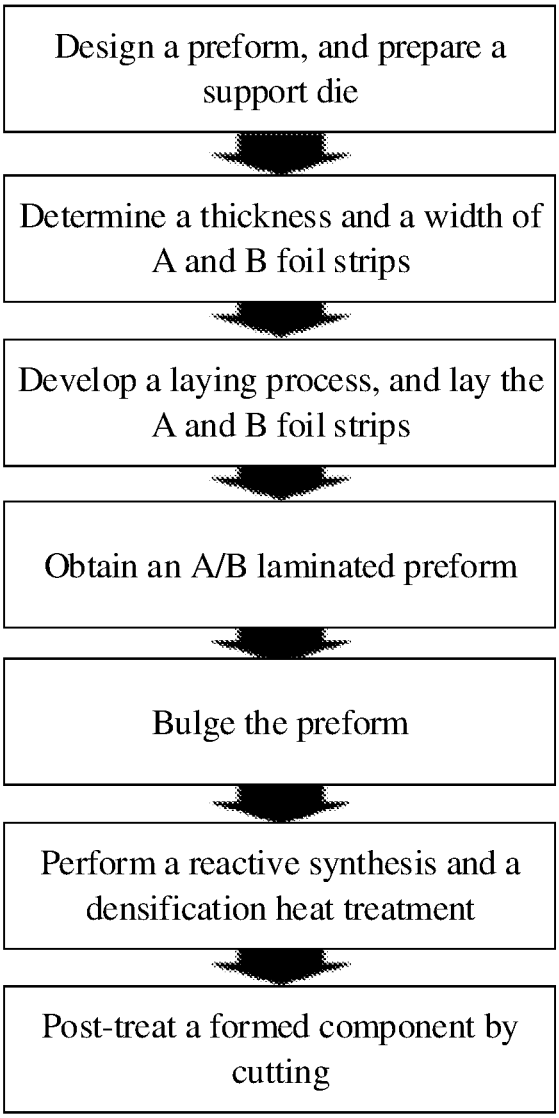
FIG. 1 is a flowchart of an integrated method for manufacturing a high-temperature resistant thin-walled component by preforming by laying a metal foil strip according to an embodiment of the present invention.

Reference Numerals: 1. preform, 2. support die, 3. robotic arm, 4. powder nozzle A, 5. foil strip nozzle A, 6. AB laminated preform, 7. powder nozzle B, 8. foil strip B, 9. rotary platform, 10. high-pressure gas source, 11. left punch,

12. water cooling plate, 13. insulating plate, 14. upper die, 15. right punch, and 16. lower die.

DETAILED DESCRIPTION

The following clearly and completely describes the technical solutions in the examples of the present invention with reference to accompanying drawings in the examples of the present invention. Apparently, the described examples are merely a part rather than all of the examples of the present invention. All other examples obtained by a person of ordinary skill in the art based on the examples of the present invention without creative efforts shall fall within the protection scope of the present invention.

An objective, among others, of the present invention is to provide an integrated method for manufacturing a high-temperature resistant thin-walled component by preforming by laying a metal foil strip, so as to solve the problems in the prior art.

To make the above objectives, features, and advantages of the present invention more obvious and easy to understand, embodiments and examples of the present invention will be further described in detail with reference to the accompanying drawings and the detailed description.

As shown in FIG. 1, an example provides an integrated method for manufacturing a high-temperature resistant thin-walled component by preforming by laying a metal foil strip, including the following steps:

Step 1, design a preform 1: analyze a characteristic of a complex thin-walled component, and determine a shape of a desired thin-walled preform 1 by a theoretical calculation or simulation;

Step 2, prepare a support die 2: prepare a support die 2 by using an inner wall of the preform 1 as a characteristic surface;

Step 3, determine a thickness of a foil strip: calculate a total thickness ratio of an A foil strip composed of a metal A to a B foil strip composed of a metal B, and determine a thickness of a single-layer foil strip, according to a ratio of the number of atoms A to the number of atoms B in an IMC composed of the metal A and the metal B;

Step 4, determine a width of the foil strip: analyze a characteristic zone of the preform 1 to determine a width of a single-layer A foil strip and a single-layer B foil strip applicable in each characteristic zone, and pretreat a desired single-layer A foil strip and a desired single-layer B foil strip;

Step 5, develop a laying process: determine a sequence and a path for laying each layer of foil, according to the thickness of the single-layer A foil strip and the single-layer B foil strip and the width of the A foil strip and the B foil strip in each zone determined in step 3 and step 4;

Step 6, lay the A foil strip and the B foil strip: alternately lay a plurality of A foil strip layers composed of the A foil strip and B foil strip layers composed of the B foil strip on a surface of the support die 2 according to the laying process developed in step 5; fill a gap between vertically adjacent A foil strips on each A foil strip layer with an A liquid or A powder made of the metal A; fill a gap between vertically adjacent B foil strips on each B foil strip layer with a B liquid or B powder made of the metal B;

Step 7, obtain an AB laminated preform 6: separate an AB laminated preform 6 prepared in step 6 from the support die 2 to obtain the AB laminated preform 6;

Step 8, bulge the preform 1: place the AB laminated preform 6 into a bulging die to bulge to fully fit with the die to obtain a component with a desired shape;

Step 9, perform a reactive synthesis and a densification process of the bulged component: subject the AB laminated component to a diffusion synthesis and a densification process under high temperature and high pressure in the bulging die to obtain a complex thin-walled alloy component;

Step 10, perform a subsequent treatment of the thin-walled component: cut or polish an end and a surface of the formed thin-walled alloy component.

The method provided by one embodiment of the present invention obtains an integral thin-walled preform 1 with a complex structure, a uniform wall thickness and a shape close to the final part by laying a metal foil strip. At least one embodiment of the present invention does not need to weld the thin-walled preform 1, and thus solves the problem of weak comprehensive performance of a weld zone in the conventional method of preparing, rolling and welding a laminated sheet into a cylinder. In addition, at least one embodiment of the present invention reduces a subsequent bulging deformation, avoiding local bulging, thinning and cracking, undercuts at the parting during die closing, or wrinkles due to uneven distribution of materials in each zone. The method uses a metal foil as a raw material, which is convenient to acquire and has controllable specifications and components. Various embodiments of the present invention can adjust the wall thickness of the thin-walled component by adjusting the thickness of the raw A foil and the raw B foil. The preparation process is safe, non-polluting and low in cost. The method makes the best use of the plastic formability of the metal foil when bulging in the die, and thus can easily prepare a part with a complex shape and high dimensional accuracy. In addition, various embodiments of the present invention also lower the requirements for the use of the die steel. The method can prepare a complex thin-walled alloy component with excellent composition uniformity and structural density in the shortest time by controlling the parameters of the reactive synthesis and the densification process. The method successively performs the bulging forming of the preform 1 and the reactive synthesis and densification process of the bulged component in the same die. At least one embodiment of the present invention satisfies the synchronous regulation of the structure and performance of each zone and effectively prevents the problem of reduced dimensional accuracy caused by the transfer of a thin-walled component. Meanwhile, embodiments of the present invention may reduce the number of procedures and improve production efficiency.

Figure 2:
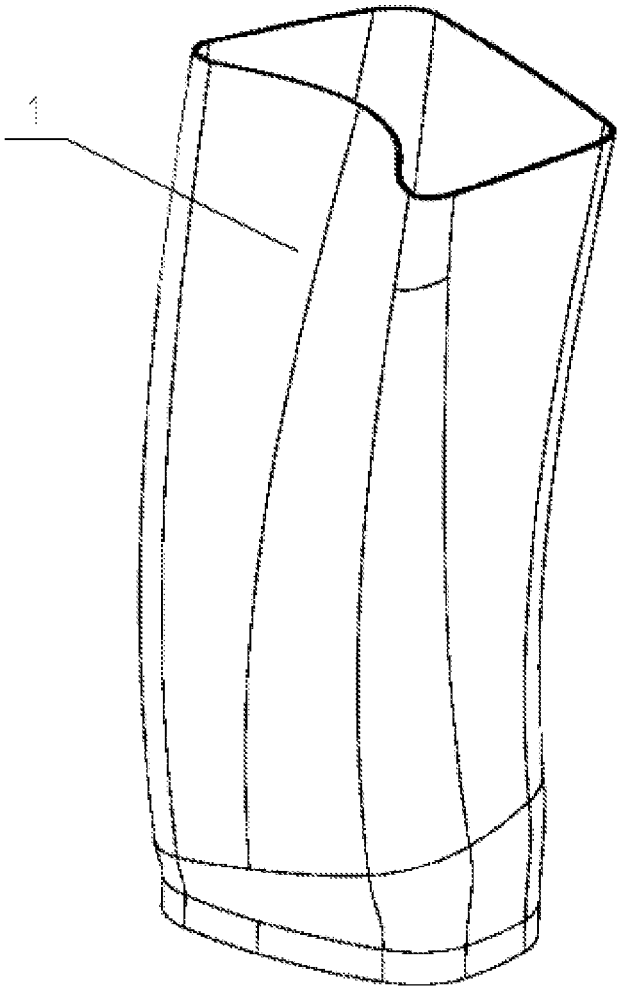
FIG. 2 is a structural diagram of a preform according to an embodiment of the present invention.

Referring to FIG. 2, in one implementation of the present invention, in step 2, the support die 2 is prepared from a material such as a foam plastic by using an inner wall of the thin-walled shaped component as a characteristic surface by a technique such as three-dimensional (3D) printing. The support die 2 is also an expendable die with a complex shape. The support die is made from a material such as a foam plastic, which is easy to acquire and low in cost. The support die uses an inner wall of the preform 1 as a characteristic surface, and has high dimensional accuracy and surface finish. The preform 1 can be conveniently separated from the support die 2 through a high-temperature heat treatment.

Figure 3:
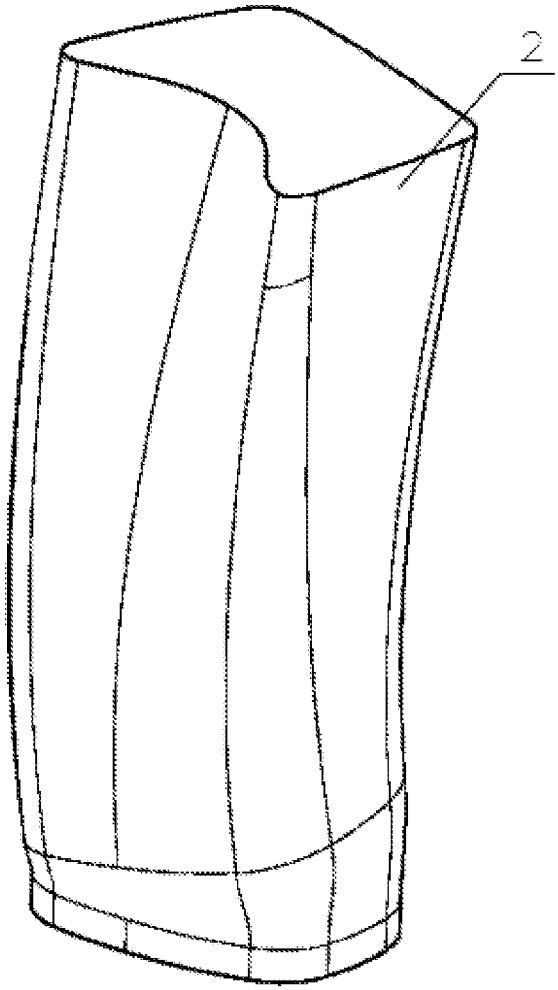
FIG. 3 is a structural diagram of a support die according to an embodiment of the present invention.

Referring to FIG. 3, in step 3, an intermetallic compound (IMC) NiAl alloy is taken as an example for description. The A atom is a Ni atom, the B atom is an Al atom, the A foil strip is a Ni foil strip, and the B foil strip is an Al foil strip. According to a number ratio of the Al atom to the Ni atom in NiAl, a total thickness ratio of the Ni foil strip to the Al foil strip is calculated and a thickness of a single-layer foil strip is determined. In this example, the Al foil strip is as thick as 0.06 mm, and the Ni foil strip is as thick as 0.1 mm. At least one embodiment of the present invention uses a metal foil as a raw material, which is convenient to acquire and has controllable specifications and components and a mature process. Such an embodiment of the present invention can adjust the wall thickness of the thin-walled component by adjusting the number of the raw foil layers. The preparation process is safe, non-polluting and low in cost.

In step 4, each characteristic zone of the preform 1 is analyzed to determine a width of a single-layer A foil strip and a single-layer B foil strip applicable in each characteristic zone. For a simple characteristic zone, a wider metal foil strip can be used. For a complex local characteristic zone, a narrower metal foil strip, and if necessary, a metal filament can be selected. An appropriate width is selected for thin-walled components with different cross-sectional shapes. In this way, various embodiments of the present invention avoid the problem of difficult preparation of a preform 1 that is close to the final part due to the wrinkling of a foil strip which is laid as a whole or is excessively wide in the case that the complexity of the characteristic zones varies.

Referring to FIG. 3, in step 6, the IMC NiAl alloy is also taken as an example for description. A foil strip nozzle A5 and a foil strip nozzle B8 are used to lay the Ni foil strip and the Al foil strip alternately layer by layer. A powder nozzle A4 is used to spray an Al liquid or Al powder to fill a gap between adjacent Al foil strips on the Al foil strip layer. A powder nozzle B 7 is used to spray a Ni liquid or Ni powder to fill a gap between adjacent Ni foil strips on the Ni foil strip layer. The support die 2 is rotated by a rotary platform 9. The foil strip nozzle and the powder nozzle are driven by a multi-degree-of-freedom robotic arm 3 to realize space movement and swing. At least one embodiment of the present invention realizes the successive alternate laying of the A and B foils layer by layer through two multi-degree-of-freedom nozzles, and obtains a thin-walled preform 1 having a complex structure, a uniform wall thickness and a shape close to the shape of the final part. In this way, an embodiment of the present invention reduces the subsequent bulging deformation, avoids local bulging, thinning and cracking, or undercuts at the parting during die closing, or wrinkles due to uneven distribution in materials in each zone. In addition, at least one embodiment of the present invention provides two other nozzles to spray an A liquid/powder or a B liquid/powder through the robotic arm 3 to fill the gap between the adjacent single-layer foil strips. This ensures the reaction of the two foils to generate a uniform alloy material, avoiding an incomplete reaction due to the lack of a local raw material.

Figure 4:
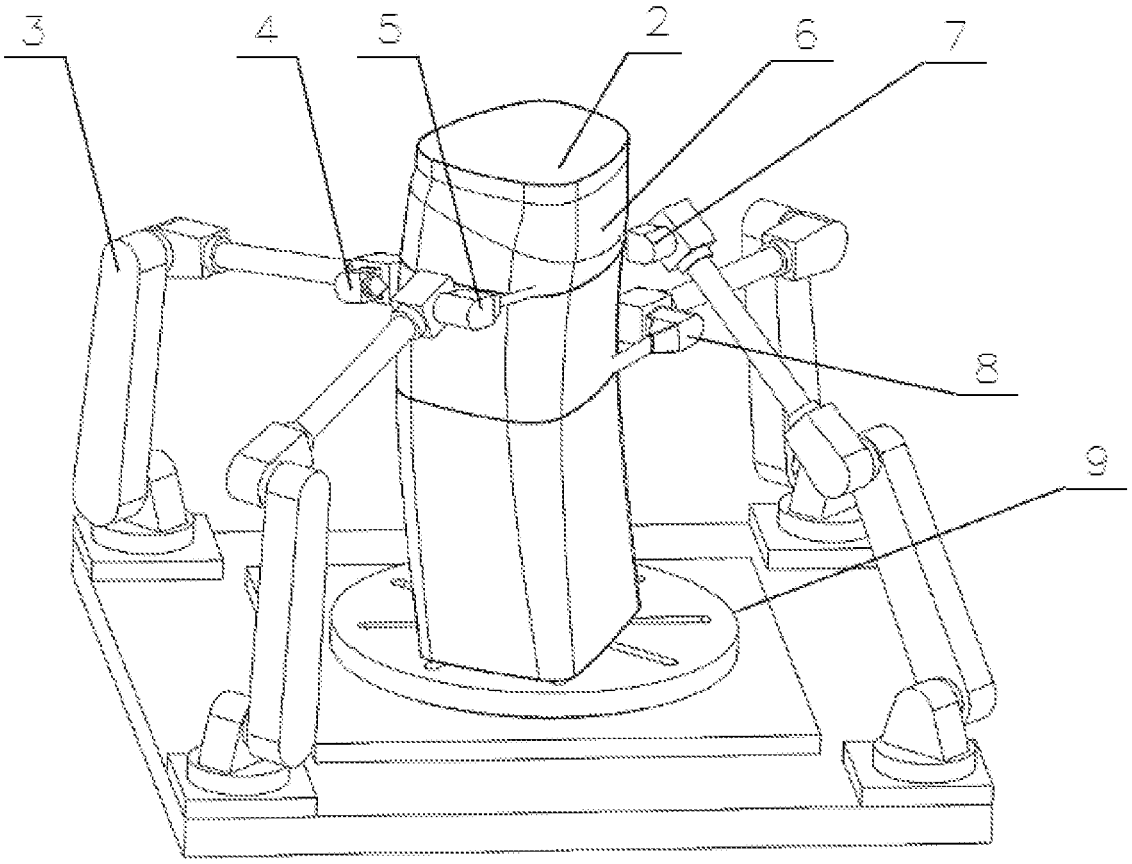
FIG. 4 is a schematic diagram of metal foil laying.

Referring to FIG. 4, in step 8, the AB laminated preform 6 is placed into the bulging die heated in advance to 500-800° C. to bulge to fit the forming die. The illustrated embodiment of the present invention performs hot gas bulging in the heated bulging die, which makes better use of the plastic formability of the metal foil, and is easy to prepare a part with a complex shape and high dimensional accuracy. In addition, at least one embodiment of the present invention also significantly lowers the requirements for the use of the die steel.

Figure 5:
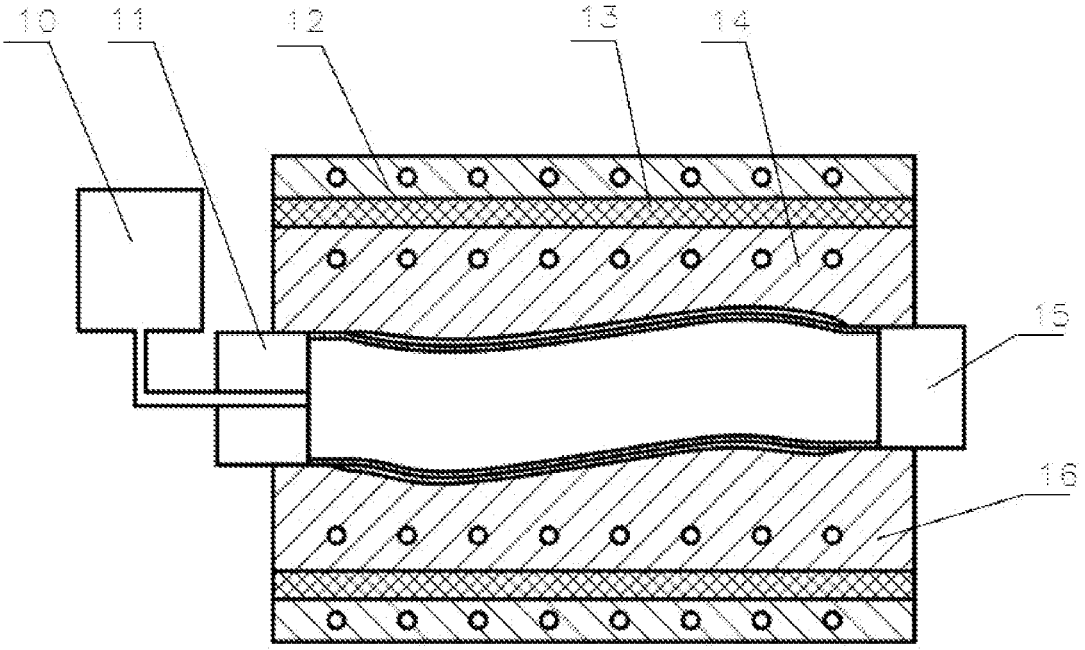
FIG. 5 is a schematic diagram of bulging a preform in a bulging die.
Figure 6:
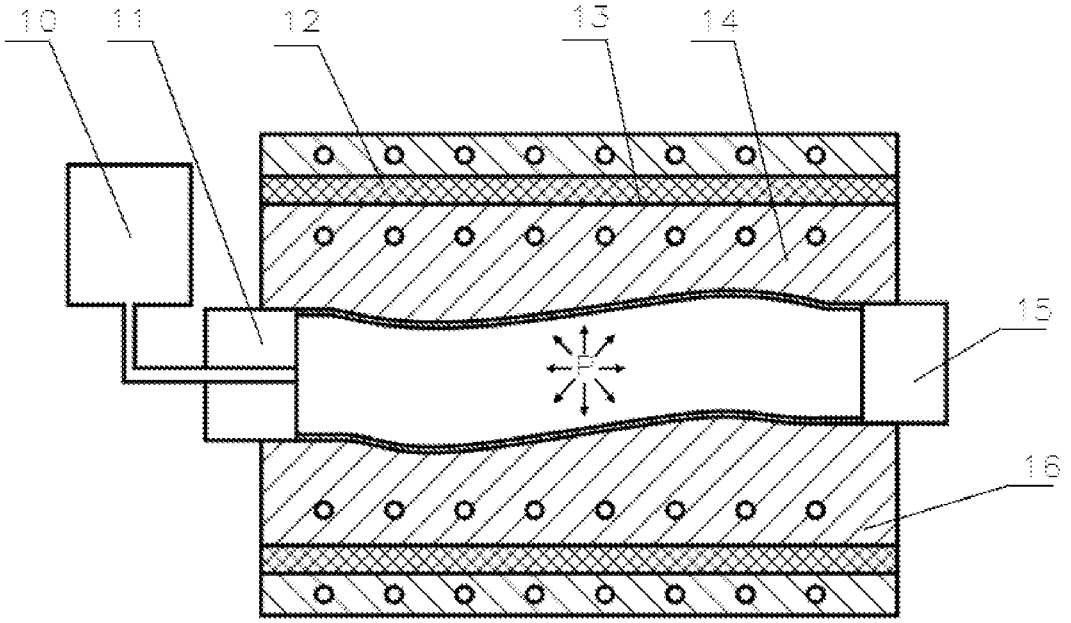
FIG. 6 is a schematic diagram of a reactive synthesis and a densification process of a bulged component in a bulging die.

Referring to FIG. 5, in step 9, when the Ni foil and the Al foil are used, a first reactive synthesis is performed. The first reactive synthesis is to raise the temperature of the bulging die to 610-650° C. and the gas pressure to 10-20 MPa, and hold the temperature and pressure for 2-5 h. Then a second reactive synthesis is performed. The second reactive synthesis is to raise the temperature of the bulging die to 1000-1300° C. and the gas pressure to 10-50 MPa, and hold the temperature and pressure for 2-4 h. Finally, a densification process is performed. The densification process is to raise the temperature of the forming die to 1000-1300° C. and the gas pressure to 50-100 MPa, and hold the temperature and pressure for 1-5 h.

Various embodiments of the present invention successively perform the bulging forming of the preform 1 and the reactive synthesis and densification process of the bulged component in the same die. Such an embodiment of the present invention effectively prevents the problem of reduced dimensional accuracy caused by the transfer a thin-walled component. Meanwhile, at least one embodiment of the present invention reduces the procedures and effectively improves production efficiency. In addition, since the densification process is performed in the bulging die, various embodiments of the present invention effectively lower the requirements for the use of a heat treatment furnace and significantly improves the dimensional accuracy of the thin-walled NiAl alloy component.

It should be noted that in the examples provided by the present invention, although only the manufacture of the complex thin-walled component of the NiAl heat-resistant IMC is specifically described, the manufacture of other complex thin-walled components of similar IMCs (TiAl, etc.) in the art can also be completed according to the above implementation steps. Therefore, only the manufacture of the thin-walled NiAl component is described, and the manufacture of other thin-walled IMC components will not be repeated.

Several examples are used for illustration of the principles and implementation methods of the present invention. The description of the examples is used to help illustrate the method and its core principles consistent with the present invention. In addition, those skilled in the art can make various modifications in terms of specific examples and scope of application in accordance with the teachings of the present invention. In conclusion, the content of this specification shall not be construed as a limitation to the present invention.

What is claimed is:

1. An integrated method for manufacturing a high-temperature resistant thin-walled component by preforming by laying a metal foil strip, comprising steps of:

defining a dimensional size and a shape for a thin-walled preform;

forming a support die by using an inner wall of the preform as a characteristic surface;

defining a thickness of a plurality of A single-layer foil strips and a plurality of B single-layer foil strips: calculating a total thickness ratio of the A single-layer foil strips composed of a metal A to the B single-layer foil strips composed of a metal B, and then calculating theft thickness of the A single-layer foil strips and the B single-layer foil strips, according to a ratio of the number of atoms A to the number of atoms B in an intermetallic compound (IMC) composed of the metal A and the metal B;

defining a width of each foil strip: defining a width for each of the A single-layer foil strips and each of the B single-layer foil strips applicable in each characteristic zone to produce the plurality of the A single-layer foil strips and the B single-layer foil strips, and pretreating each of the A single-layer foil strips and each of the B single-layer foil strips;

developing a laying process: determining a sequence and a path for laying each layer of foil, according to the thickness of the A single-layer foil strips and the B single-layer foil strips and the width of the A single-layer foil strips and the B single-layer foil strips in each characteristic zone;

laying the A single-layer foil strips and the B single-layer foil strips: alternately laying the plurality of A single-layer foil strips and B single-layer foil strips on a surface of the support die according to the sequence and the path for laying each layer of foil;

filling a first gap between the A single-layer foil strips vertically adjacent to each other with one of an A liquid or an A powder made of the metal A, and filling a second gap between the B single-layer foil strips vertically adjacent to each other with one of a B liquid or B powder made of the metal B to define an AB laminated preform on the support die;

obtaining the AB laminated preform: separating the AB laminated preform from the support die to obtain the AB laminated preform;

bulging the AB laminated preform: placing the AB laminated preform into a bulging die to bulge to fully fit with the bulging die to produce a bulged component with a desired shape;

performing a reactive synthesis and a densification process of the bulged component: subjecting the bulged component to a diffusion synthesis and a densification process under a high temperature and a high pressure in the bulging die to produce a complex thin-walled alloy component;

performing a subsequent treatment of the complex thin-walled alloy component: cutting or polishing an end and a surface of the complex thin-walled alloy component;

wherein the support die is formed from a foam plastic by using an inner wall of the thin-walled shaped component as the characteristic surface by three-dimensional (3D) printing.

2. The integrated method for manufacturing a high-temperature resistant thin-walled component by preforming by laying a metal foil strip according to claim 1, wherein during the step of laying the foil strips, two foil strip nozzles are used to lay the A single-layer foil strips and the B single-layer foil strips alternately layer by layer; a first powder nozzle is used to spray one of the A liquid or the A powder to fill the first gap between the vertically adjacent A single-layer foil strips on a layer of A foil; a second powder nozzle is used to spray one of the B liquid or the B powder to fill the second gap between the vertically adjacent B single-layer foil strips on a layer of B foil; the support die is rotated by a rotary platform; a foil strip nozzle and the first and second powder nozzles are driven by a multi-degree-of-freedom robotic arm to realize space movement and swing.

3. The integrated method for manufacturing a high-temperature resistant thin-walled component by preforming by laying a metal foil strip according to claim 1, wherein in the bulging step, the AB laminated preform is placed into the bulging die heated in advance to 500-800° C. to bulge to fit the bulging die.

* * * * *